US006067437A

United States Patent [19]

Schönfeld

[11] Patent Number: 6,067,437

[45] Date of Patent: May 23, 2000

[54] DEVICE FOR FIXING TONER IMAGES

[75] Inventor: Carsten Schönfeld, Kiel, Germany

[73] Assignee: Heidelberger Druckmaschinen AG, Heidelberg, Germany

[21] Appl. No.: 09/212,645

[22] Filed: Dec. 15, 1998

[30] Foreign Application Priority Data

Dec. 15, 1997 [DE] Germany ..... 197 55 584

[51] Int. Cl.[7] ..... G03G 15/20

[52] U.S. Cl. ..... 399/320; 399/335

[58] Field of Search ..... 399/320, 335; 118/58

[56] References Cited

U.S. PATENT DOCUMENTS 5,140,377 8/1992 Lewis et al. ..... 399/335

5,461,470 10/1995 DeCock et al. ..... 399/228

*Primary Examiner*—William Royer

*Assistant Examiner*—William A. Noe

*Attorney, Agent, or Firm*—Herbert L. Lerner; Laurence A. Greenberg; Werner H. Stemer

[57] ABSTRACT

A method for fixing a toner image contact-free on a substrate, which includes exposing the toner image to a hot gas containing a significant component of steam; and a device for performing the method.

6 Claims, 2 Drawing Sheets

DEVICE FOR FIXING TONER IMAGES

BACKGROUND OF THE INVENTION

Field of the Invention

The invention relates to a method and a device for fixing toner images with a gas to which the toner images are exposed For the purpose of fixing toner images in electrophotography and related processes, a fundamental distinction is drawn between contact and noncontact methods. The first group includes fixing with hot rolls or belts and pressure fixing, the latter, if necessary, under the influence of elevated temperature. The second group includes, for example, radiation methods using lamps which operate continuously or in a pulsed manner, or the physicochemical methods of fixing by solvent evaporation.

Among these methods, hot-roll fixing has achieved wide popularity to date, although it is accompanied by some disadvantages, which have to be paid for elsewhere through increased outlay or through losses in print quality. A great problem with which hot-roll fixing is beset, is so-called "hot offset", in which molten toner remains adhering to the roll surface and is deposited onto the substrate during subsequent revolutions. A characteristic "ghost image" is produced.

In order to counter this defect, the roll materials which are selected have a low surface energy (such as PTFE or silicone rubber, for example), and in addition a low-viscosity release agent, generally silicone oil, is applied to the surface thereof. These measures lead both to making the unit more expensive and also to the undesired application of silicone oil to the print, and thus to uncontrollable gloss. Likewise, in order to prevent hot offset, inconvenient requirements are placed upon the toner that is used; the mechanical moduli of the toner (visco-elastic properties) must be set so that an adequate elastic component counteracts the hot offset. This impairs the ability of the toner to flow during fixing, extending as far as suppressing the adequate coalescence of toner droplets. The impaired ability to flow also has a disadvantageous effect upon the process of toner production, because excessively elastic materials present difficulties during the grinding process. Furthermore, in order to suppress hot offset, internal release agents are added to the toner, which in turn complicate the production of toner and make the toner more expensive.

The second group of fixing methods, the noncontact methods, do not have the problems of hot offset. The toners can therefore be produced as "capable of ideal flow", no silicone oil and no internal release agents being needed. The disadvantages of the noncontact method relate to the controlled introduction of the necessary heat into the toner layer. In the case of all radiation systems, the thermal efficiency, at least at relatively high fixing speeds, is lower than in the case of roll fixing.

Continuously operating radiation systems have, in substance, a safety problem, which has to be overcome at the expense of outlay on machine construction. This is because, if the paper transport is interrupted, for example, by a paper jam, the risk of ignition of the paper is high. For this reason, these systems are normally used in web-fed presses wherein the paper transport can be monitored relatively easily, but not in sheet-fed presses.

Radiation methods operating in a pulsed manner, so-called flash-fusing systems, often produce local overheating of the toner layer, which leads to thermal degradation of the polymers and therefore to the emission of unhealthy and unacceptably smelly gases. In addition, it has been reported that, as a result of the rapid heating-up of the toner layer, the latter tends toward microexplosions, the traces of which prevent uniform area filling.

The method of fixing with solvent vapor operates in accordance with the principle that the toner layer on the substrate is caused to swell by the vapors. As a result, a liquid ink film is produced on the substrate, is basically able to behave like a liquid printing ink and should deliver potentially high image quality. Following the fixing, the solvent is removed from the substrate. The disadvantages of the method are obvious: operating with organic solvents in a printing press is undesirable from the aspects of environmental protection and health and safety at work. In addition, heretofore known systems are also still based on halogenated solvents (CFC), the use of which is being considered less and less.

All heretofore known methods, which operate with temperatures significantly above 100° C. (typical fixing temperatures are around 170° C.) also damage the paper, that is the most important printing substrate, in that they drive out the water contained therein, leading to deformation.

SUMMARY OF THE INVENTION

It is accordingly an object of the invention to provide a method and a device for fixing toner images, more particularly, for contact-free fixing of a toner image on a substrate by a gas, to which the toner image is exposed, which avoids the foregoing problems by providing a gas that is hot and contains a significant component of steam.

With the foregoing and other objects in view, there is provided, in accordance with one aspect of the invention, a method for fixing a toner image contact-free on a substrate, which comprises exposing the toner image to a hot gas containing a significant component of steam.

In accordance with another mode of the method according to the invention, the hot gas is at a temperature between about 150° C. and 400° C.

In accordance with a further mode, the method according to the invention includes transporting the substrate through a zone wherein the toner image is exposed to the gas, and then transporting the substrate through a zone wherein it is actively cooled down.

In accordance with an added mode of the method according to the invention, the substrate is paper.

In accordance with another aspect of the invention, there is provided a device for fixing toner images contact-free on a substrate, comprising a transport device for transporting the substrate through a fixing zone wherein the toner images are exposable to a gas, and a device for generating hot gas with a significant component of steam feedable to a substantially closed space in the fixing zone which surrounds the toner images when the substrate is located in the fixing zone.

In accordance with yet another feature, the fixing device according to the invention includes a housing substantially closed except for being open on one side thereof, the open side being adjacent to a substrate transport path slightly spaced therefrom, the housing and the substrate transport path defining the substantially closed space.

In accordance with yet a further feature, the fixing device according to the invention includes a housing substantially closed on all sides, which defines the substantially closed space, the housing being formed with two elongated narrow openings through which a substrate transport path extends.

In accordance with yet an added feature of the fixing device according to the invention, the hot gas is at a temperature between about 150° C. and 400° C.

In accordance with yet an additional feature, the fixing device according to the invention includes a cooling device for cooling the substrate after the latter has left the substantially closed space.

In accordance with a concomitant feature of the fixing device according to the invention, the substrate is paper.

Thus, the fixing device according to the invention constitutes a system for contact-free fixing which, as opposed to radiation systems, uses steam as the heat transport medium and, as opposed to solvent vapor systems, does not effect any noticeable swelling of the toner. The fixing action is essentially based upon the fact that the heat stored in the superheated steam is transferred to the toner due to the collision of the water molecules with the latter, which results in the melting of the toner. If the substrate is paper, the increased water content of the hot air delays drying-out of the paper. In addition, cooling which is performed directly after the fixing can counteract the drying-out of the paper.

Although the gas may be up to 100% steam, in practice the gas will be a mixture of air and steam. However, the efficiency of the heat transfer to the toner decreases with an increasing fraction of air. When paper is used as the printing substrate, it is possible for the ratio of steam and air in the gas to be set so that any drying-out of the paper is counteracted in an optimum fashion.

Using the invention, toner images can be fixed both on individual sheets and on endless paper as a printing substrate.

According to the invention, a device for contact-free fixing of toner images on a substrate, having a transport device for transporting the substrate through a fixing zone wherein the toner images are exposed to a gas, contains a device for generating hot gas with a significant component of steam, the gas being feedable into a substantially closed space which surrounds the toner image when it is located in the fixing zone.

In a first embodiment, the fixing device according to the invention contains a housing which is substantially closed except that it has one open side adjoining a substrate transport path spaced a slight distance therefrom, the housing and the substrate transport path defining the substantially closed space.

In a second embodiment, the fixing device contains a housing which is substantially closed on all sides thereof and defines the substantially closed space, the housing being formed with two elongated, narrow openings, through which a substrate transport path runs.

The closed space or oven, which contains the fixing gas and through which transport of the substrate takes place, cannot be made very gastight without a high outlay of engineering. Fewer sealing problems result if the pressure of the fixing gas does not differ significantly from atmospheric pressure, so that, even in the case of certain unavoidable leaks, no noticeable gas exchange with the environment takes place.

Heat exchange can be intensified by a nozzle arrangement provided in the oven for spraying the steam onto the substrate in concentrated form. Alternatively, it is also possible for the oven to be constructed so that the presence of the steam on its own has the effect of melting the toner, essentially without any pronounced forced flow, i.e., with only convection taking place.

Other features which are considered as characteristic for the invention are set forth in the appended claims.

Although the invention is illustrated and described herein as embodied in a method and a device for fixing toner images, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
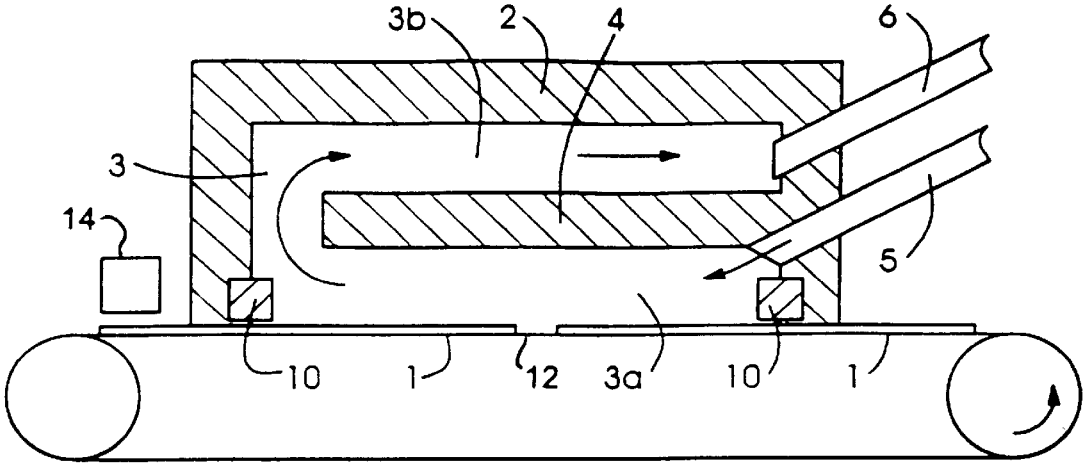
FIG. 1 is a diagrammatic cross-sectional view of a first embodiment of a fixing oven according to the invention, which is disposed above a substrate transport path.

In an electrographic printer, paper sheets pass various stations one after another, specifically an exposure station, a developing station and a fixing station. Referring now to the figures of the drawing and, first, particularly to FIG. 1 thereof, there is shown therein two successive paper sheets 1 passing the fixing station, the sheets 1 lying on a level section of a transport belt 12 running to the lefthand side in the figure. The transport belt 12 has an upper side 16 and a lower side 18 (See FIG. 2). The fixing station essentially contains a cuboidal housing 2 extending over the width of the sheet and having an open side facing towards the paper sheets 1. The distance between the side walls of the housing 2 and the paper sheets 1 is made as small as possible, so that an essentially closed space 3 is formed in the interior of the housing 2. For a given spacing between the side walls of the housing 2, on the one hand, and the paper sheets 1, on the other hand, which only just permits the contact-free paper transport to pass the housing 2, it is possible for the gastightness of the space 3 to be improved with the aid of seals 10 provided on the undersides of the housing, opposite the paper sheets 1, as is shown diagrammatically in FIGS. 1 and 2.

The housing 2 is subdivided by a dividing wall or partition 4 into a lower subspace 3*a* and an upper subspace 3*b*, which are connected to one another at the left-hand side of FIG. 1, so that the space 3 has a U-shaped cross section. At the right-hand side of FIG. 1, gas inlet lines 5 open into the lower subspace 3*a* and gas outlet lines 6 open into the upper subspace 3*b*. Hot steam at a temperature of, for example, 300° C. is fed out of the gas inlet lines 5, passes through the space 3 in the direction of the appertaining arrows, and leaves the space 3 via the gas outlet lines 6.

The hot steam sweeps over the paper sheets 1 while the latter are passing the fixing station, as a result of which the toner images applied to the paper sheets 1 in the nonillustrated developing station disposed upline of the fixing station are caused to melt. After the sheets 1 have left the fixing station, the toner images and paper sheets 1, respectively, are cooled by a cooling device 14, so that the toner images are permanently joined to the paper.

Figure 2:
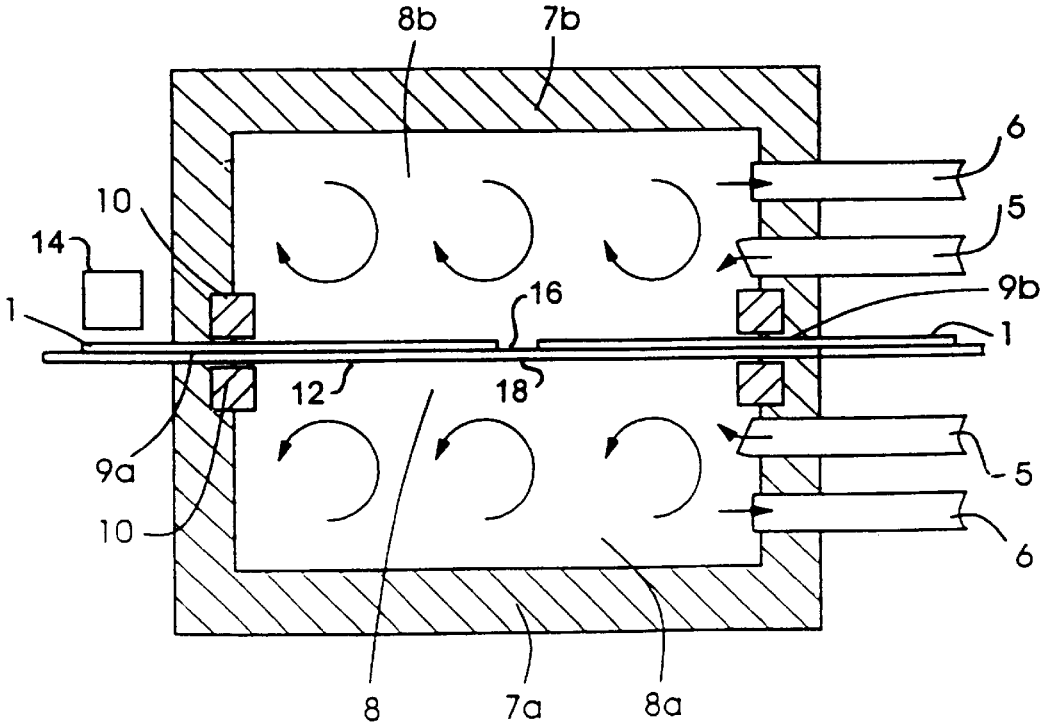
FIG. 2 is a diagrammatic cross-sectional view of a second embodiment of the fixing oven, which surrounds a substrate transport path.

FIG. 2 shows a different embodiment of the fixing station according to FIG. 1, in which two housing halves 7*a* and 7*b*, which are each similar to the housing 2 of FIG. 1, are located with the open sides thereof disposed opposite one another, by which a substantially closed space 8 with a lower subspace 8*a* and an upper subspace 8*b* is formed. The side walls of the housing halves 7*a* and 7*b* are at a small distance from one another, in order to form elongate, narrow openings 9*a* and 9*b*, through which the paper sheets 1 are transported to the lefthand side or to the righthand side of the figure. The housing halves 7*a* and 7*b*, respectively, are connected to gas inlet and gas outlet lines 5 and 6, as in FIG. 1. In this exemplary embodiment of FIG. 2, however, the housing halves 7*a* and 7*b* do not have any dividing walls like the housing 2 of FIG. 1, instead the hot vapor moves within each subspace 8*a* and 8*b* essentially as a result of convection when the vapor cools down at the paper surface, as indicated by the arcuate arrows.

In the exemplary embodiment of FIG. 2, it is not only the upper side of the sheet, which has the toner images thereon, that is swept by hot steam, but also the underside of the sheet. This very reliably counteracts any drying-out of the paper. It is possible in many ways to ensure that the steam will also reach the underside of the sheet. For example, the sheet can be held at the sides thereof while it is passing the space 8, or a gas-permeable transport belt can be used therefor.

Figure 3:
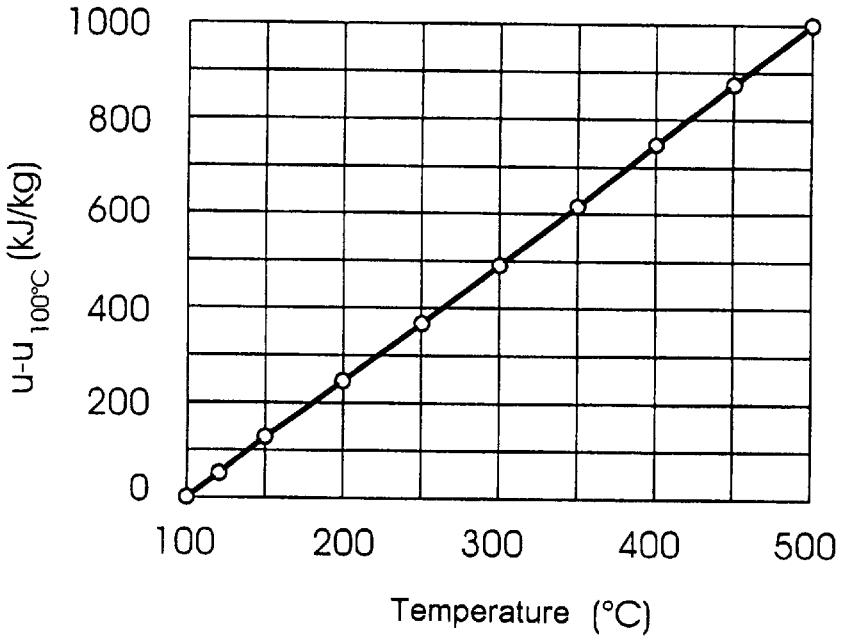
FIG. 3 is a plot diagram showing the excess of internal energy of superheated steam.

FIG. 3 shows an estimate of the available energy content U of the steam, when the latter is cooled from a temperature T to 100° C. while passing through the housing 2 or the housing halves 7*a* and 7*b*.

There follows a closer investigation of the energy balance for the convection fixing of toner in a toner fixing station for electrographic printing systems, the functional principle of which is based upon blowing hot gas into an oven chamber, convection fixing as shown in FIG. 2 being assumed.

In contrast with other contact-free fixing methods known to date, for example radiation fixing, in the method according to the invention of the instant application, the energy which is incident in the form of heat radiation from the heating elements is not used directly for the fixing. With reference to two examples, specifically the introduction either of hot air or of hot steam, the following simple estimate shows that the concept of heat transport by heated steam is feasible. The variables and constants used for the estimate are:

| | | |
|---|---|---|
| Molar internal energy | [$Jmol^{-1}$] | U |
| Molar heat capacity | [$JK^{-1}mol^{-1}$] | $c_p$ |
| Thermodynamic temperature | [K] | T |
| Molar volume | [$m^3mol^{-1}$] | Vm |
| Energy per unit volume | [$Jm^{-3}$] | $E_v$ |
| Power | [W] | P |
| Pressure | [Pa] | p |
| Volume flow | [$m^3s^{-1}$] | $I_v$ |
| General gas constant | [$JK^{-1}mol^{-1}$] | R = 8.3144 $JK^{-1}$ $mol^{-1}$ |

Calculating the Energy of Hot Air

The internal energy of a gas is the product of heat capacity and temperature:

$$dU=c_p \cdot dT. \tag{1}$$

Dividing by the molar volume $V_m$ yields the energy per unit volume $E_v$, $$dE_V = \frac{c_p}{V_m} \cdot dT. \tag{2}$$

If the molar volume of ideal gases $V_m$=RT/p is used as an approximation, this gives $$dE_V = \frac{c_p p}{RT} \cdot dT, \tag{3}$$

or, in integral form, $$E_V = \frac{c_p p}{R} \cdot \int_{T_1}^{T_2} \frac{dT}{T} \tag{4}$$

$$E_V = \frac{c_p p}{R} \cdot \ln\frac{T_2}{T_1}, \tag{5}$$

The available heat power P of the air then results from multiplication by the volume flow $I_v$:

$$P = I_V c_p \frac{p}{R} \cdot \ln\frac{T_2}{T_1}. \tag{6}$$

After taking into account a conversion factor for the fixing efficiency $f_e$, the fixing power $P_f$ is obtained as $$P_f = f_e \cdot I_V c_p \frac{p}{R} \cdot \ln\frac{T_2}{T_1}. \tag{7}$$

Solving for $T_2$ results in $$T_2 = T_1 \cdot \exp\left(\frac{R}{c_p p} \cdot \frac{P_f}{f_e I_V}\right). \tag{8}$$

Estimating the Energy Needed for Fixing

Assumption 1:

Both the main constituents of air, namely $N_2$ (78%) and $O_2$ (21%) have a molar heat capacity of $c_p$=29 J $K^{-1}$ $mol^{-1}$. Therefore, this value should also be used for dry air.

Assumption 2:

The pressure in the fixing chamber is p=1·$10^5$ Pa (1 bar)

Assumption 3:

The final temperature of the air must not lie below the softening temperature of normal toner. This is set at 127° C., therefore $T_1$=400 K.

According to G. Goldmann, Technologie der OPS-Hochleistungs-drucker [The technology of the OPS high capacity printer], in Das Druckerbuch (Oce Printing Systems, 1992, pp. 3–16), the energy demand Q for fixing toner is essentially given by the heat capacity of the paper and the heat of evaporation of the water stored in the paper. At a water content of 5%, the energy demand Q=236 J/$cm^3$. The amount of energy taken up by the toner is negligible because of the small amount of toner.

Assumption 4:

The following assumption was made for the estimate:

| | |
|---|---|
| Paper weight | G = 0.15 kg/m$^2$ |
| Printing speed | v = 0.3 m/s |
| Printing width | l = 0.3 m |
| Density | r = 700 kg/m$^3$ |

Hence, in the printing process, the paper volume throughput per unit time is $$\frac{V_p}{t} = \frac{G \cdot 1 \cdot v}{\rho} = 2 \cdot 10^{-5} \frac{m^3}{s} = 20 \frac{cm^3}{s} \tag{9}$$

and the power needed for fixing is given as $$P_f = \frac{Q}{t} = 236 J/cm^3 \cdot 20 cm^3/s, \text{ therefore} \tag{10}$$

$$P_f \approx 4.5 \text{ kW} \tag{11}$$

Assumption 5:

The efficiency of the fixing is $f_e$=0.1, and thus 10%.

Substituting the values for $T_1$, $c_p$, p, $P_f$ and $f_e$ from Assumptions 1 to 5 into Eq. (8) gives $$T_2 = 400K \cdot \exp\left(\frac{0.13 m^3 S^{-1}}{I_V}\right) \tag{12}$$

According to this equation, for example for an air delivery capacity of $4 \cdot 10^{-3}$ m$^3$s$^{-1}$ (=15 m$^3$/h, which corresponds to the delivery capacity of conventional pumps with a 1 kW power consumption), a temperature of $5 \cdot 10^{16}$ K is calculated, i.e., an impracticably high value.

If Eq. (12) is solved for the volume flow $I_v$:

$$I_V = \frac{0.13 m^3 S^{-1}}{\ln(T_2/400K)}, \tag{13}$$

it is then possible to calculate the necessary volume flow of the air for a given air temperature. In the case of the maximum possible temperature of the air, it must be taken into account that paper ignites at about 233° C. (506 K). If this temperature for the hot air is inserted, a volume flow of 0.55 m$^3$s$^{-1}$ is calculated. However, at 300° C., 0.36 m$^3$s$^{-1}$ is still obtained, and 0.25 m$^3$s$^{-1}$ at 400° C. Such high volume flows can be realized only with a considerable outlay for engineering.

Steam as Heat Transport Medium

Equation (8) describes the relationship between the gas temperature used for fixing and the necessary volume flow $$T_2 = T_1 \cdot \exp\left(\frac{R}{c_p p} \cdot \frac{P_f}{f_e I_V}\right) \tag{8}$$

In order to change the system so that it becomes technically feasible, it is necessary for the exponent in Eq. (8) to be reduced. This can be effected, for example, by increasing the efficiency $f_e$ or increasing the pressure p. In each case, the aim is to attain the highest technically feasible efficiency. Whether it is possible to attain a value significantly above 10%, or whether this value is reached at all, remains to be tested. Increasing the pressure is possible only with a high outlay for engineering, and is therefore ruled out.

Options which remain are reducing the power $P_f$ needed for fixing, and increasing the heat capacity $c_p$ of the gas. Both are possible by using steam as the heat transport medium. $P_f$ is reduced, because driving water out of the paper is prevented or at least retarded in a steam atmosphere, and thus, according to Goldmann (cf. above), only about 50% of the energy is still needed for fixing. On the other hand, $c_p$ is increased, because steam makes a significant difference with respect to air, with 33.6 JK$^{-1}$ mol$^{-1}$ instead of 29 JK$^{-1}$ mol$^{-1}$.

Inserting these values into Eq. (8), given otherwise unchanged conditions, yields, in a manner similar to Eq. (12) and (13):

$$T_2 = 400K \cdot \exp\left(\frac{0.056 m^3 s^{-1}}{I_V}\right) \tag{14}$$

$$I_V = \frac{0.056 m^3 s^{-1}}{\ln(T_2/400K)}. \tag{15}$$

At a gas temperature of 300° C., the computation now yields a volume flow of 0.16 m$^3$s$^{-1}$, which corresponds to an improvement of about 66% over hot air.

Figure 4:
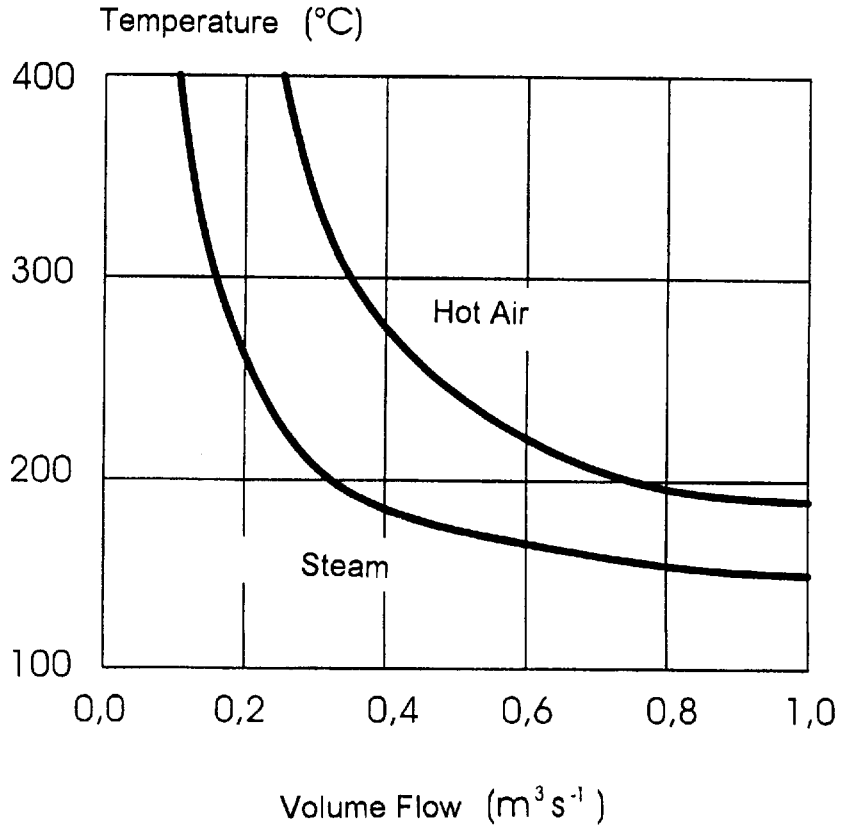
FIG. 4 is a plot diagram showing the gas temperature needed for convection fixing as a function of the volume flow of hot air or steam as the heat transport medium.

These relationships are illustrated by FIG. 4, which shows the necessary gas temperature as a function of the volume flow in the case of the convection fixing of toners, for hot air and steam as the heat transport medium, in accordance with Equations (12) and (14).

I claim:

1. A device for fixing toner images on a substrate, comprising:

a housing part having an open side;

a transport device having a first side for transporting a substrate past said open side of said housing part, said housing part being adjacently spaced from said first side of said transport device to define a substantially closed space;

a device for generating hot gas with a significant component of steam, said device feeding the hot gas into said substantially closed space for fixing toner images on the substrate.

2. The device for fixing toner images according to claim 1, wherein the hot gas is at a temperature between about 150° C. and 400° C.

3. The device for fixing toner images according to claim 1, including a cooling device for cooling the substrate after the substrate has left said substantially closed space.

4. The device for fixing toner images according to claim 1, wherein the substrate is paper.

5. The device for fixing toner images according to claim 1, wherein said housing part defines a first housing part and said transport device has a second side opposite said first side, the device for fixing toner images including:

a second housing part having an open side, said second housing part being adjacently spaced from said second side of said transport device.

6. The device for fixing toner images according to claim 5, wherein said first housing part and said second housing part define a complete housing having two elongated narrow openings through which said transport device extends.

* * * * *